US012553314B2

(12) United States Patent
Maher et al.

(10) Patent No.: US 12,553,314 B2
(45) **Date of Patent: *Feb. 17, 2026**

(54) DEBRIS REMOVAL APPARATUS WITH SELF CLEANING FILTER ASSEMBLY, WELL SYSTEM AND METHOD OF USE

(71) Applicant: Halliburton Energy Services, Inc., Houston, TX (US)

(72) Inventors: Peter Reid Maher, Lafayette, LA (US); Nicholas Albert Kuo, Carrollton, TX (US); Austin Lee Wright, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/675,812

(22) Filed: May 28, 2024

(65) Prior Publication Data

US 2024/0309730 A1 Sep. 19, 2024

Related U.S. Application Data

(63) Continuation of application No. 17/093,878, filed on Nov. 10, 2020, now Pat. No. 12,006,795.

(51) Int. Cl.
*E21B 37/08* (2006.01)
*E21B 43/38* (2006.01)

(52) U.S. Cl.
CPC ..... *E21B 37/08* (2013.01); *E21B 43/38* (2013.01)

(58) Field of Classification Search
CPC ..... E21B 37/08; E21B 37/00; E21B 37/02
See application file for complete search history.

(56) References Cited

U.S. PATENT DOCUMENTS

| | | | |
|---|---|---|---|
| 1,758,995 | A | 5/1930 | Armstrong et al. |
| 3,901,320 | A | 8/1975 | Calderon et al. |
| 6,250,387 | B1 | 6/2001 | Carmichael et al. |
| 6,776,231 | B2 | 8/2004 | Allen |
| 7,472,745 | B2 | 1/2009 | Lynde et al. |
| 9,038,736 | B2 | 5/2015 | Knobloch, Jr. et al. |
| 10,532,299 | B2 | 1/2020 | Prost et al. |
| 12,006,795 | B2 * | 6/2024 | Maher ..... E21B 43/38 |
| 2012/0292047 | A1 | 11/2012 | Knobloch, Jr. et al. |
| 2014/0216176 | A1 | 8/2014 | Kimour |
| 2017/0136391 | A1 | 5/2017 | Crandall et al. |

(Continued)

FOREIGN PATENT DOCUMENTS

| | | | |
|---|---|---|---|
| EP | 3156584 | B1 | 9/2018 |
| WO | 2020167623 | A1 | 8/2020 |

*Primary Examiner* — Sean D Andrish
(74) *Attorney, Agent, or Firm* — Scott Richardson; Parker Justiss, P.C.

(57) ABSTRACT

This disclosure provides a downhole debris removal apparatus, a method for operating a downhole debris removal apparatus, and a well system including the same. The downhole debris removal apparatus, in one aspect, includes an inner pipe positioned within a tubular, and a filtration member substantially encircling the inner pipe. The downhole debris removal apparatus, in this aspect, further includes a cleaning assembly positioned radially about at least a portion of the filtration member, the cleaning assembly configured to move relative to the filtration member to dislodge particulate matter from the filtration member.

21 Claims, 5 Drawing Sheets

(56) References Cited

U.S. PATENT DOCUMENTS

| | | | | |
|---|---|---|---|---|
| 2018/0015395 | A1 | 1/2018 | Prost et al. | |
| 2018/0258738 | A1* | 9/2018 | Ian | E21B 33/12 |
| 2019/0153796 | A1 | 5/2019 | van Hove et al. | |

* cited by examiner

DEBRIS REMOVAL APPARATUS WITH SELF CLEANING FILTER ASSEMBLY, WELL SYSTEM AND METHOD OF USE

CROSS-REFERENCE TO RELATED APPLICATION

This application is a continuation of U.S. patent application Ser. No. 17/093,878, entitled "DEBRIS REMOVAL APPARATUS WITH SELF CLEANING FILTER ASSEMBLY", filed on Nov. 10, 2020. The above-listed application is commonly assigned with the present application is incorporated herein by reference as if reproduced herein in its entirety.

BACKGROUND

Well operations, such as milling out a tool or pipe in a wellbore or a frac operation, create debris that needs to be collected and removed from the well. For example, a bottom-hole assembly with a mill is made up with a debris collection tool. Debris collection tools are sometimes referred to as junk baskets, collector baskets or debris screens. There are a variety of different collection tools that operate on different principles. However, in general, these various tools have a common objective of separating circulating fluid from the cuttings and/or other debris that is present in the wellbore. In some tools, reverse circulation is created at the lower end of the tubing string and is used to circulate the debris into the collection tool. Reverse circulation is generally created by using a tool, sometimes referred to as a power head, to direct flow laden with cuttings and/or particulate material into a debris removal assembly.

DETAILED DESCRIPTION

Figure 1:
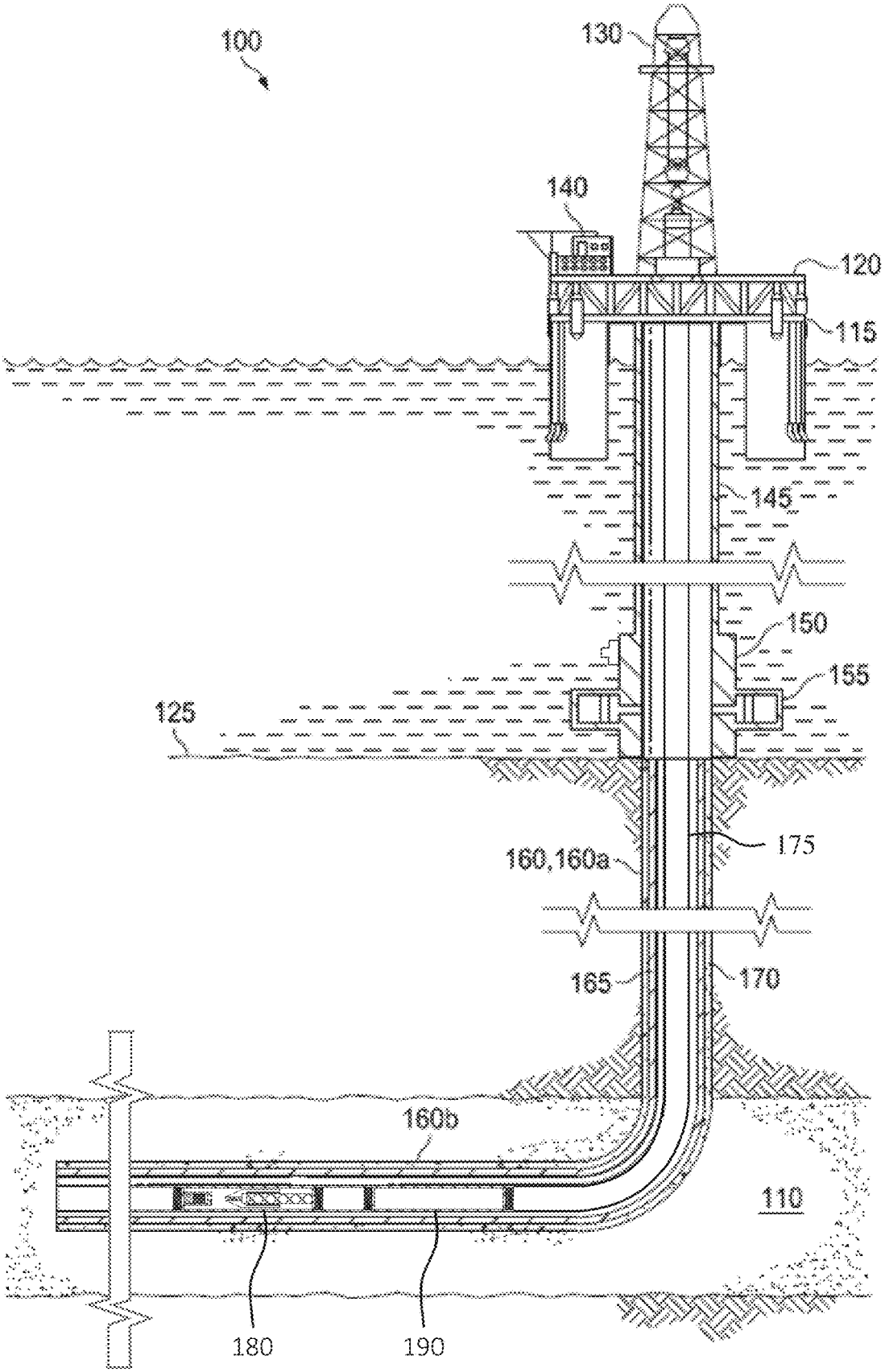
FIG. 1 illustrates a well system including a downhole debris removal apparatus designed, manufactured and/or operated according to the present disclosure.

Downhole debris removal apparatuses often use chambers with filtration members to assist in collecting fine debris or debris that has been circulated past other collection chambers. If these filtration members become filled with debris and completely prevent the flow of fluid, a packoff may occur, which may necessitate pulling the entire string out of the hole to clean the filtration members. The present disclosure provides a downhole debris removal apparatus with a cleaning assembly, the cleaning assembly configured to move relative to the filtration member to dislodge particulate matter from the filtration member. Accordingly, the cleaning assembly is configured to keep at least a portion of the filtration member free of particulate matter to allow the downhole debris removal apparatus to continue to function.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring initially to FIG. 1, schematically illustrated is a well system 100, including a downhole debris removal apparatus 180 designed, manufactured and/or operated according to the present disclosure. The well system 100 of FIG. 1, without limitation, includes a semi-submersible platform 115 having a deck 120 positioned over a subterranean (e.g., oil and gas) formation 110, which in this embodiment is located below sea floor 125. The platform 115, in the illustrated embodiment, may include a hoisting apparatus/derrick 130 for raising and lowering various oil and gas components, such as conveyances, work string, production tubing, etc. The well system 100 illustrated in FIG. 1 may additionally include a control system 140 located on the deck 120, or elsewhere. The control system 140, in one embodiment, may be used to control various different aspects of the well system 100.

A subsea conduit 145 extends from the platform 115 to a wellhead installation 150, which may include one or more subsea blow-out preventers 155. A wellbore 160 extends through the various earth strata including the subterranean formation 110. In the embodiment of FIG. 1, wellbore casing 165 is cemented within wellbore 160 by cement 170, and includes a conveyance 175 therein. The conveyance 175 may be any known conveyance, nevertheless in one or more embodiments the conveyance 175 is work string or production string.

In the illustrated embodiment, wellbore 160 has an initial, generally vertical portion 160*a* and a lower, generally deviated portion 160*b*, which is illustrated as being horizontal. It should be noted by those skilled in the art, however, that the downhole debris removal apparatus 180 of the present disclosure is equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, those skilled in the art understand that the principles of the present disclosure are equally as applicable to other subterranean formations, including those encompassing both areas below exposed earth and areas below earth covered by water such as ocean or fresh water.

In accordance with one embodiment of the disclosure, the downhole debris removal apparatus 180 includes an inner pipe positioned within a tubular, and a filtration member substantially encircling the inner pipe. The downhole debris removal apparatus 180, in accordance with this embodiment, further includes a cleaning assembly positioned radially about at least a portion of the filtration member, the cleaning assembly configured to move relative to the filtration member to dislodge particulate matter from the filtration member. The cleaning assembly, in one embodiment, is configured to rotate relative to the filtration member. The cleaning assembly, in another embodiment, is configured to translate relative to the filtration member. In yet another embodiment, the cleaning assembly is configured to rotate and translate relative to the filtration member. Coupled to the downhole debris removal apparatus 180 (e.g., positioned uphole of the downhole debris removal apparatus 180) in the embodiment of FIG. 1 is a power head 190. The power head 190, in this embodiment, is operable to provide fluid circulation through the downhole debris removal apparatus 180.

Figure 2:
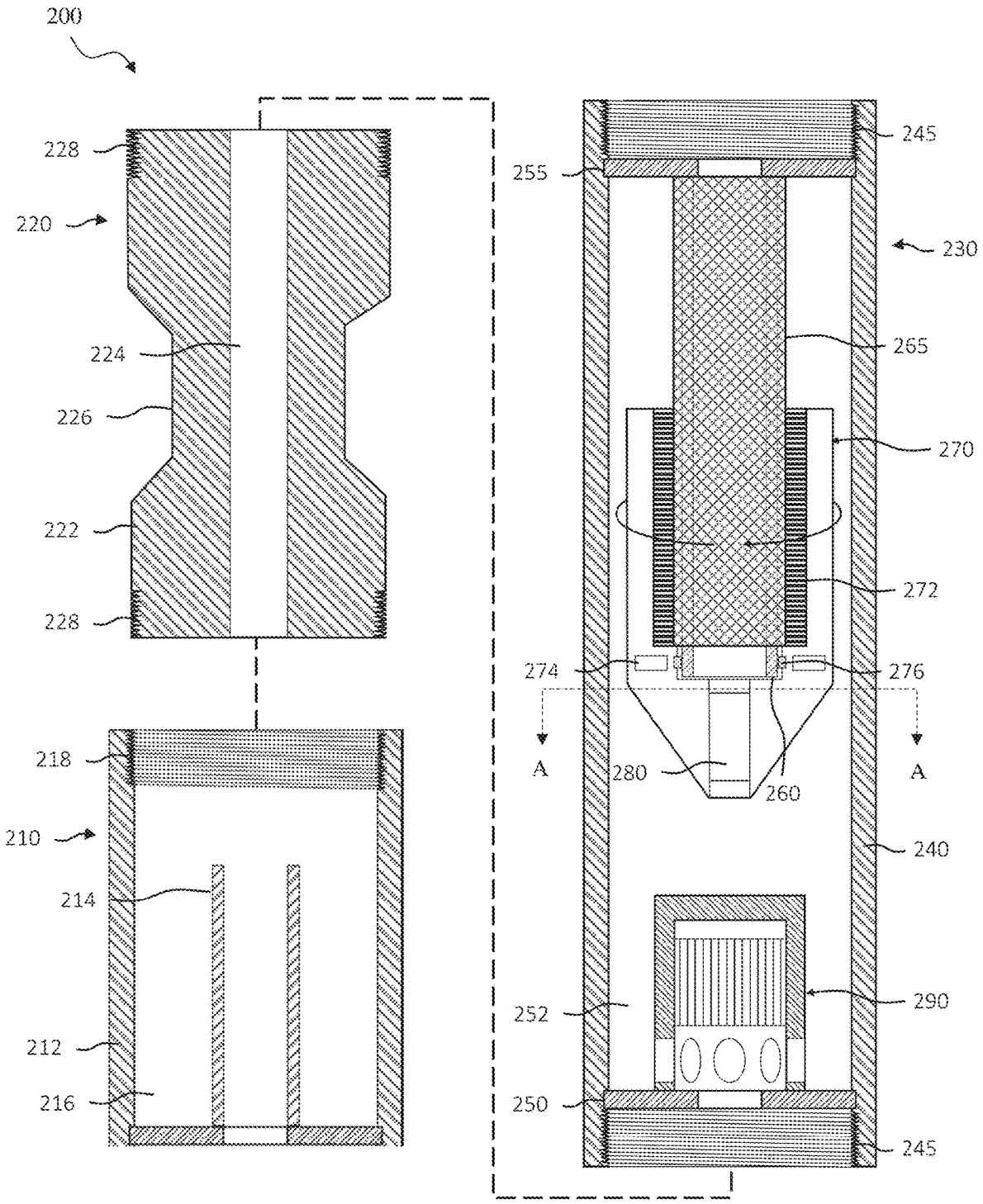
FIG. 2 illustrates a downhole debris removal apparatus designed, manufactured and operated according to one or more embodiments of the disclosure.

Referring now to FIG. 2, schematically illustrated is a downhole debris removal apparatus 200 designed, manufactured and operated according to one or more embodiments of the disclosure. The downhole debris removal apparatus 200, in the illustrated embodiment, includes a debris collection sub 210, a handling sub 220, and a debris removal sub 230. In the illustrated embodiment, the debris collection sub 210 is positioned downhole of the debris removal sub 230, with the handling sub 220 interposing (e.g., and coupling) the debris collection sub 210 and the debris removal sub 230. Nevertheless, while the debris removal sub 230 is often uphole of the debris collection sub 210, the handling sub 220 need not be positioned between the two. Thus, in certain other embodiments the handling sub 220 could be located downhole of the debris collection sub 210 or uphole of the debris removal sub 230, and remain within the scope of the disclosure. In yet other embodiments, the downhole debris removal apparatus 200 does not include the debris collection sub 210 or the handling sub 220, but only includes the debris removal sub 230.

The debris collection sub 210 may comprise a variety of different configurations and remain within the scope of the disclosure. Nevertheless, in the embodiment of FIG. 2 the debris collection sub 210 includes a tubular 212, for example having an inner pipe 214 positioned therein. The inner pipe 214, in the illustrated embodiment, only extends partially upward into the tubular 212. Accordingly, the tubular 212 and inner pipe 214 create a collection chamber 216 used to remove larger debris from fluid (e.g., circulating fluid, drilling fluid, etc.). For example, as the fluid flows uphole through the debris collection sub 210, the fluid goes from the smaller diameter inner pipe 214 to the larger diameter tubular 212, thereby decreasing in velocity and releasing at least a portion of the debris accumulated therein into the collection chamber 216. The debris collection sub 210 additionally includes a connector 218, which in the embodiment shown is a box connector.

The handling sub 220 may also comprise a variety of different configurations and remain within the scope of the disclosure. The handling sub 220, in the embodiment of FIG. 2, nevertheless includes a housing 222 having a fluid passageway 224 extending there through. The handling sub 220, in the illustrated embodiment, additionally includes an indented portion 226. The indented portion 226, in certain instances, may be grasped by existing tongs and/or tools at the well site when it is necessary to empty the collection chamber 216. The handling sub 220 additionally includes a pair of connectors 228 (e.g., pin connectors) for coupling with the debris collection sub 210 and the debris removal sub 230.

The debris removal sub 230, in accordance with one or more embodiments of the disclosure, includes a tubular 240. The tubular 240 may comprise a variety of different tubulars and remain within the scope of the disclosure. In one embodiment, the tubular 240 is a steel tubular, such as an American Petroleum Institute (API) pipe. In accordance with one or more embodiments of the disclosure, the tubular 240 may have a pair of connectors 245 for coupling the debris removal sub 230 to the handling sub 220, as well as coupling the debris removal sub 230 to an additional uphole sub (e.g., a power head).

Positioned at opposing ends within the tubular 240 in the embodiment of FIG. 2 are a first base plate 250 and a second base plate 255. The first base plate 250, in the illustrated embodiment, is located proximate a downhole end of the tubular 240. Likewise, the second base plate 255, in the illustrated embodiment, is located proximate an uphole end of the tubular 240. The first and second base plates 250, 255, as shown, may include openings extending there through for allowing fluid to enter, traverse and exit the debris removal sub 230. Furthermore, the first base plate 250 may form a debris collection chamber 252 in the tubular 240.

In the illustrated embodiment, an inner pipe 260 is positioned within the tubular 240. The inner pipe 260, in the illustrated embodiment, extends partially downward into the tubular 240 from the second base plate 255. In other embodiments, however, the inner piper 260 might extend substantially downward into the tubular 240, or possibly entirely downward into the tubular 240. In the embodiment of FIG. 2, the inner pipe 260 includes a plurality of openings or slots therein (not shown) for allowing fluid to move from an exterior of the inner pipe 260 to an interior of the inner pipe 260.

Positioned around the inner pipe 260, in the embodiment of FIG. 2, is a filtration member 265. The filtration member 265, as illustrated, may substantially encircle the inner pipe 260. In accordance with one embodiment, the filtration member 265 is a screen assembly. In accordance with another embodiment, the filtration member 265 might be a mesh assembly, or any other known or hereafter discovered filtration member. The filtration member 265 may have many different filter porosities and remain within the scope of the disclosure, for example depending on a size of the particulate matter that is being filtered out.

Positioned radially about at least a portion of the filtration member 265 is a cleaning assembly 270. The cleaning assembly 270, in accordance with the disclosure, is designed to move relative to the filtration member 265 to dislodge particulate matter from the filtration member 265. In the illustrated embodiment of FIG. 2, the cleaning assembly 270 includes one or more brushes, wipers or petals 272 that move relative to the filtration member 265 to dislodge the particulate matter from the filtration member 265. Further to the embodiment of FIG. 2, the cleaning assembly 270 is configured to rotate relative to the filtration member 265 to dislodge the particulate matter from the filtration member 265. While the embodiment of FIG. 2 illustrates that the cleaning assembly 270 rotates relative to the filtration member 265, other embodiments may exist wherein the cleaning assembly 270 translates relative to the filtration member 265 (e.g., see FIG. 4). Furthermore, even other embodiments may exist wherein the cleaning assembly 270 rotates and translates relative to the filtration member 265. While the present disclosure illustrates the inner pipe 260 and the filtration member 265 as being fixed, and thus the cleaning assembly 270 doing the moving, other embodiments may exist wherein just the opposite is happening. Additionally, wherein FIG. 2 illustrates a single cleaning assembly 270, other embodiments may exist wherein two or more cleaning assemblies 270 are employed for a single downhole debris removal apparatus 200.

In one embodiment, an actuator 274 and bearing 276 coupled between the cleaning assembly 270 and the inner pipe 260 may be used to move the cleaning assembly 270 relative to the filtration member 265. The actuator 274 may comprise a variety of different actuators and remain within the scope of the disclosure. In one embodiment, the actuator is a hydraulic actuator. In other embodiments, however, the actuator 274 might be a manual actuator, an electric actuator or a pneumatic actuator.

Figure 3A:
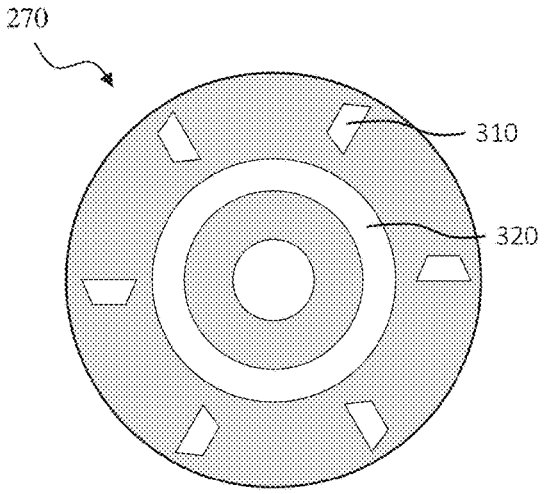
FIGS. 3A through 3C illustrate cross-sectional view through line A-A of the cleaning assembly of FIG. 2.
Figure 3B:
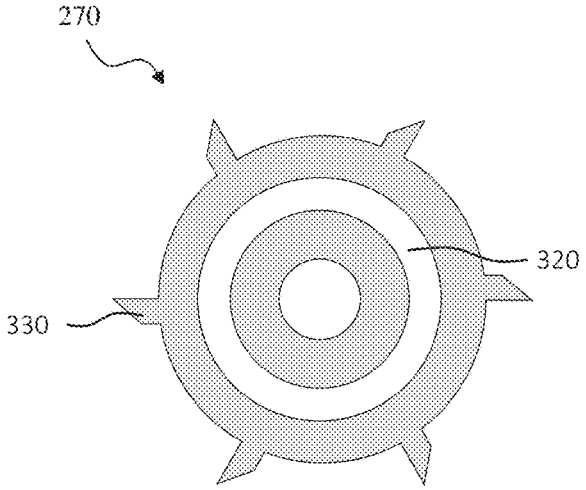
Figure 3C:
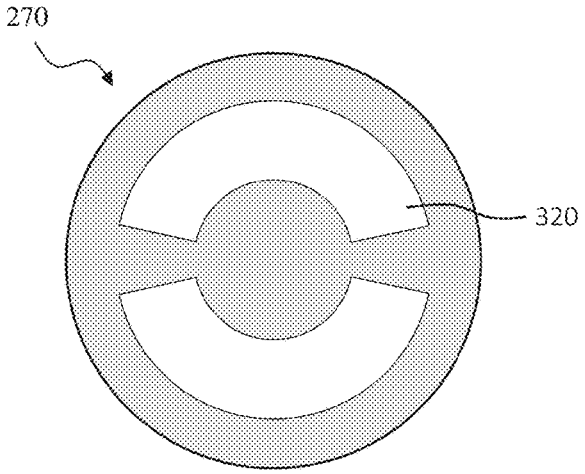

Turning briefly to FIGS. 3A through 3C, illustrated are cross-sectional views through line A-A of alternative embodiments of the cleaning assembly 270. FIG. 3A illustrates that the cleaning assembly 270 may include one or more internal flow channels 310. The internal flow channels 310, in combination with fluid travelling there through, may be sufficient to spin the cleaning assembly 270 and thus create the relative movement. The internal flow channels 310 may embody any number and/or shape necessary to spin the cleaning assembly 270. The cleaning assembly 270 illustrated in FIG. 3A additionally includes one or more debris flow paths 320 to allow the dislodged particulate matter to fall from the filtration member 265 to the debris collection chamber 252.

FIG. 3B illustrates that the cleaning assembly 270 may include one or more impeller blades 330. The impeller blades 330, in combination with fluid travelling there past, may be sufficient to spin the cleaning assembly 270. The impeller blades 330 may embody any number and/or shape necessary to spin the cleaning assembly 270. While not shown, the cleaning assembly 270 might include a combination of the internal flow channels 310 and the impeller blades 330. FIG. 3C illustrates that the cleaning assembly 270 may include a fixed bullnose, with impeller blades and a bearing system (e.g., similar to FIGS. 3A and 3B) connected to a ring fixed to the filtration member 265.

Returning to FIG. 2, the debris removal sub 230 of the illustrated embodiment additionally includes a bypass assembly 280 coupled to the inner pipe 260. The bypass assembly 280, in this embodiment, is designed to open when a pressure differential between an exterior of the inner pipe 260 and an interior of the inner pipe 260 increases to a predetermined value. For example, if the cleaning assembly 270 were to stop working, or not be able to keep up, particulate matter might entirely stop up the filtration member 265, and thus create a packoff situation (e.g., causing the pressure differential to hit the predetermined value). If so, the bypass assembly 280 would open the interior of the inner pipe 260 to the fluid flow, thus substantially equalizing the pressure differential and preventing the packoff situation. Furthermore, if the cleaning assembly 270 were to begin working again, or catch back up, the bypass assembly 280 could then re-close and thus allow the filtration member 265 to continue to filter the fluid.

The debris removal sub 230 illustrated in the embodiment of FIG. 2 additionally may include a check valve 290 positioned proximate the first base plate 250. The check valve 290, in the illustrated embodiment, is operable to be open during reverse flow and closed during normal flow. In the embodiment shown, the check valve 290 and the first base plate 250 help define the collection chamber 252. In the absence of the check valve 290, an inner pipe 214 could be used.

A downhole debris removal apparatus, such as the downhole debris removal apparatus 200, may be operated to filter downhole fluid. In this operation, the downhole debris removal apparatus (e.g., including a debris removal sub according to the disclosure) would be positioned downhole. Thereafter, fluid would be circulated through the debris removal sub. At some point after the fluid has begun to circulate through the debris removal sub (e.g., while the fluid is circulating, or after the fluid has circulated) the cleaning assembly of the debris removal sub would be moved relative to the filtration member of the debris removal sub to dislodge particulate matter from the filtration member. In certain embodiments, the cleaning assembly rotates relative to the filtration member, but in other embodiments it translates, or rotates and translates, relative to the filtration member. In certain embodiments, the circulated fluid creates the relative rotation of the cleaning assembly. In other embodiments, an actuator (or a combination of an actuator and the circulated fluid) creates the relative rotation of the cleaning assembly. Nevertheless, regardless of whether the circulated fluid or an actuator creates the relative rotation, the downhole debris may be used in horizontal, vertical and deviated wellbores alike. Furthermore, if a pressure differential between an exterior of an inner pipe of the debris removal sub and an interior of the inner pipe of the debris removal sub increases a predetermined value, a bypass assembly coupled to the inner pipe may be opened to prevent a packoff situation.

Figure 4:
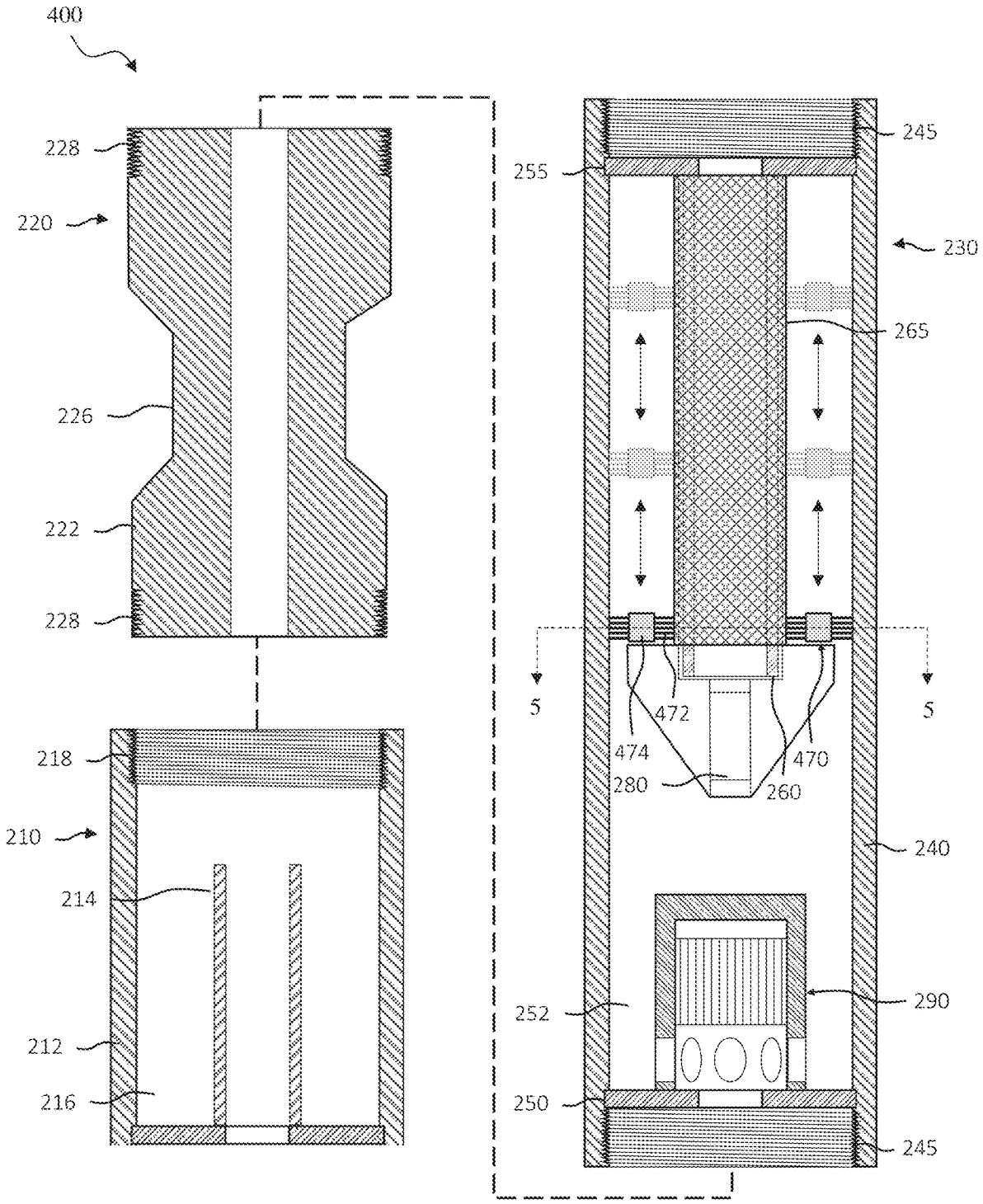
FIG. 4 illustrates an alternative embodiment of a downhole debris removal apparatus designed, manufactured and operated according to another embodiment of the disclosure.

Referring now to FIG. 4, schematically illustrated is an alternative embodiment of a downhole debris removal apparatus 400 designed, manufactured and operated according to one or more embodiments of the disclosure. The downhole debris removal apparatus 400 illustrated in FIG. 4 is similar in many respects to the downhole debris removal apparatus 200 illustrated in FIG. 2. Accordingly, like reference numbers have been used to indicate similar, if not substantially identical, features. The downhole debris removal apparatus 400 differs, for the most part, from the downhole debris removal apparatus 200, in that the downhole debris removal apparatus 400 employs a cleaning assembly 470 that translates relative to the filtration member 265, as opposed to rotates relative to the filtration member 265. The cleaning assembly 470, in the illustrated embodiment, includes one or more brushes, wipers or petals 472 positioned on a ring 474 that move relative to the filtration member 265 to dislodge the particulate matter from the filtration member 265. In the illustrated embodiment of FIG. 4, the one or more brushes, wipers or petals 472 are positioned on an interior of the ring 474 to clean the filtration member 265, but are also positioned on an exterior of the ring 474 to clean the tubing 240.

Figure 5:
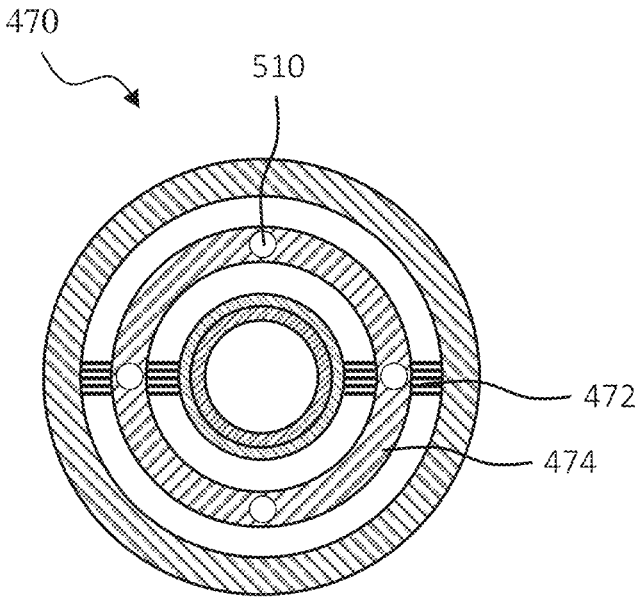
FIG. 5 illustrates a cross-sectional view through line B-B of the cleaning assembly of FIG. 4.

Turning briefly to FIG. 5, illustrated is a cross-sectional views through line B-B of the cleaning assembly 470. FIG. 5 illustrates the ring 474 having the one or more brushes, wipers or petals 472 positioned on an interior and exterior surface thereof. FIG. 5 additionally illustrates that the ring 474 may have one or more openings 510 therein, such that fluid may pass between an uphole surface of the ring 474 and a downhole surface of the ring 474.

In operation of the downhole debris removal apparatus 400 of FIG. 4, circulating fluid would flow through the check valve 290 and into an interior of the tubular 240. The circulating fluid would then contact the cleaning assembly 470, and thus cause the cleaning assembly 470 to translate uphole (e.g., as a result of the fluid pressure thereon). As the cleaning assembly 470 translated uphole, the one or more brushes, wipers or petals 472 would essentially clean the filtration member 265. Furthermore, the amount of circulation fluid may be modulated (e.g., the flow rate increased and decreased) to thereby allow the cleaning assembly 470 to translate uphole and downhole against the filtration member 265, thereby cleaning a substantial portion of a length of the filtration member 265.

Aspects disclosed herein include:

A. A downhole debris removal apparatus, the downhole debris removal apparatus including: 1) an inner pipe positioned within a tubular; 2) a filtration member substantially encircling the inner pipe; and 3) a cleaning assembly positioned radially about at least a portion of the filtration member, the cleaning assembly configured to move relative to the filtration member to dislodge particulate matter from the filtration member.

B. A method for operating a downhole debris removal apparatus, the method including: 1) providing a debris removal sub downhole, the debris removal sub including; a) an inner pipe positioned within a tubular; b) filtration member substantially encircling the inner pipe; and c) a cleaning assembly positioned radially about at least a portion of the filtration member; 2) circulating fluid through the debris removal sub; and 3) moving the cleaning assembly relative to the filtration member to dislodge particulate matter from the filtration member.

C. A well system, the well system including: 1) a wellbore extending into a subterranean formation; 2) a conveyance located within the wellbore; 3) a downhole debris removal apparatus positioned within the wellbore with the conveyance, the downhole debris removal apparatus including: a) an inner pipe positioned within a tubular; b) filtration member substantially encircling the inner pipe; and c) a cleaning assembly positioned radially about at least a portion of the filtration member, the cleaning assembly configured to move relative to the filtration member to dislodge particulate matter from the filtration member; and 4) a power head coupled to the downhole debris removal apparatus, the power head operable to provide fluid circulation through the downhole debris removal apparatus.

Aspects A, B, and C may have one or more of the following additional elements in combination: Element 1: wherein the cleaning assembly is configured to rotate relative to the filtration member. Element 2: wherein the cleaning assembly includes one or more internal flow channels to create the rotation of the cleaning assembly relative to the filtration member. Element 3: wherein the cleaning assembly includes one or more impeller blades to create the rotation of the cleaning assembly relative to the filtration member. Element 4: wherein the cleaning assembly is configured to translate relative to the filtration member. Element 5: wherein the cleaning assembly is configured to rotate and translate relative to the filtration member. Element 6: wherein the cleaning assembly includes one or more brushes, wipers or petals configured to dislodge the particulate matter from the filtration member. Element 7: further including an actuator coupled to the cleaning assembly for moving the cleaning assembly relative to the filtration member. Element 8: wherein the actuator is a manual actuator, pneumatic actuator, hydraulic actuator, or an electric actuator. Element 9: further including a base plate located at a downhole end of the tubular, the base plate and tubular forming a debris collection chamber at the downhole end of the tubular. Element 10: wherein the cleaning assembly further includes one or more debris flow paths to allow the dislodged particulate matter to fall to the debris collection chamber. Element 11: further including a check valve positioned proximate the base plate, the check valve operable to be open during reverse flow and closed during normal flow. Element 12: further including a bypass assembly coupled to the inner pipe, the bypass assembly configured to open when a pressure differential between an exterior of the inner pipe and an interior of the inner pipe hits a predetermined value. Element 13: wherein the bypass assembly is configured to prevent a packoff situation in the downhole debris removal apparatus. Element 14: wherein the tubular, inner pipe, filtration member and cleaning assembly form at least a portion of a debris removal sub, and further including a debris collection sub and handling sub coupled to the debris removal sub. Element 15: wherein moving the cleaning assembly relative to the filtration member includes rotating the cleaning assembly relative to the filtration member or translating the cleaning assembly relative to the filtration member. Element 16: wherein moving the cleaning assembly relative to the filtration member includes rotating the cleaning assembly relative to the filtration member and translating the cleaning assembly relative to the filtration member. Element 17: wherein the debris removal sub further includes a bypass assembly coupled to the inner pipe, and further including opening the bypass assembly when a pressure differential between an exterior of the inner pipe and an interior of the inner pipe hits a predetermined value.

Those skilled in the art to which this application relates will appreciate that other and further additions, deletions, substitutions and modifications may be made to the described embodiments.

What is claimed is:

1. A downhole debris removal apparatus, comprising:

an inner pipe positioned within a tubular;

a filtration member substantially encircling the inner pipe;

a cleaning assembly positioned radially about at least a portion of the filtration member, the cleaning assembly configured to move relative to the filtration member to dislodge particulate matter from the filtration member; and a bypass assembly coupled to the inner pipe, the bypass assembly configured to open when a pressure differential between an exterior of the inner pipe and an interior of the inner pipe hits a predetermined value, wherein the bypass assembly is configured to prevent a packoff situation in the downhole debris removal apparatus.

2. The downhole debris removal apparatus as recited in claim 1, wherein the cleaning assembly is configured to rotate relative to the filtration member.

3. The downhole debris removal apparatus as recited in claim 2, wherein the cleaning assembly includes one or more internal flow channels to create the rotation of the cleaning assembly relative to the filtration member.

4. The downhole debris removal apparatus as recited in claim 2, wherein the cleaning assembly includes one or more impeller blades to create the rotation of the cleaning assembly relative to the filtration member.

5. The downhole debris removal apparatus as recited in claim 1, wherein the cleaning assembly is configured to translate relative to the filtration member.

6. The downhole debris removal apparatus as recited in claim 1, wherein the cleaning assembly is configured to rotate and translate relative to the filtration member.

7. The downhole debris removal apparatus as recited in claim 1, wherein the cleaning assembly includes one or more brushes, wipers or petals configured to dislodge the particulate matter from the filtration member.

8. The downhole debris removal apparatus as recited in claim 1, further including an actuator coupled to the cleaning assembly for moving the cleaning assembly relative to the filtration member.

9. The downhole debris removal apparatus as recited in claim 8, wherein the actuator is a manual actuator, pneumatic actuator, hydraulic actuator, or an electric actuator.

10. The downhole debris removal apparatus as recited in claim 1, further including a base plate located at a downhole end of the tubular, the base plate and tubular forming a debris collection chamber at the downhole end of the tubular.

11. The downhole debris removal apparatus as recited in claim 10, wherein the cleaning assembly further includes one or more debris flow paths to allow the dislodged particulate matter to fall to the debris collection chamber.

12. The downhole debris removal apparatus as recited in claim 10, further including a check valve positioned proximate the base plate, the check valve operable to be open during reverse flow and closed during normal flow.

13. The downhole debris removal apparatus as recited in claim 1, wherein the tubular, inner pipe, filtration member and cleaning assembly form at least a portion of a debris removal sub, and further including a debris collection sub and handling sub coupled to the debris removal sub.

14. A method for operating a downhole debris removal apparatus, comprising:

providing a debris removal sub downhole, the debris removal sub including:

an inner pipe positioned within a tubular;

filtration member substantially encircling the inner pipe;

a cleaning assembly positioned radially about at least a portion of the filtration member; and a bypass assembly coupled to the inner pipe, the bypass assembly configured to open when a pressure differential between an exterior of the inner pipe and an interior of the inner pipe hits a predetermined value, wherein the bypass assembly is configured to prevent a packoff situation in the downhole debris removal apparatus;

circulating fluid through the debris removal sub; and moving the cleaning assembly relative to the filtration member to dislodge particulate matter from the filtration member.

15. The method as recited in claim 14, wherein moving the cleaning assembly relative to the filtration member includes rotating the cleaning assembly relative to the filtration member or translating the cleaning assembly relative to the filtration member.

16. The method as recited in claim 14, wherein moving the cleaning assembly relative to the filtration member includes rotating the cleaning assembly relative to the filtration member and translating the cleaning assembly relative to the filtration member.

17. The method as recited in claim 14, further including opening the bypass assembly when the pressure differential between the exterior of the inner pipe and the interior of the inner pipe hits the predetermined value.

18. A well system, comprising:

a wellbore extending into a subterranean formation;

a conveyance located within the wellbore;

a downhole debris removal apparatus positioned within the wellbore with the conveyance, the downhole debris removal apparatus including:

an inner pipe positioned within a tubular;

filtration member substantially encircling the inner pipe; and a cleaning assembly positioned radially about at least a portion of the filtration member, the cleaning assembly configured to move relative to the filtration member to dislodge particulate matter from the filtration member; and a bypass assembly coupled to the inner pipe, the bypass assembly configured to open when a pressure differential between an exterior of the inner pipe and an interior of the inner pipe hits a predetermined value, wherein the bypass assembly is configured to prevent a packoff situation in the downhole debris removal apparatus; and a power head coupled to the downhole debris removal apparatus, the power head operable to provide fluid circulation through the downhole debris removal apparatus.

19. A downhole debris removal apparatus, comprising:

an inner pipe positioned within a tubular;

a filtration member substantially encircling the inner pipe;

a cleaning assembly positioned radially about at least a portion of the filtration member, the cleaning assembly configured to move relative to the filtration member to dislodge particulate matter from the filtration member;

a base plate located at a downhole end of the tubular, the base plate and tubular forming a debris collection chamber at the downhole end of the tubular; and a check valve positioned proximate the base plate, the check valve operable to be open during reverse flow and closed during normal flow.

20. A downhole debris removal apparatus, comprising:

an inner pipe positioned within a tubular;

a filtration member substantially encircling the inner pipe;

a cleaning assembly positioned radially about at least a portion of the filtration member, the cleaning assembly configured to move relative to the filtration member to dislodge particulate matter from the filtration member, wherein an actuator is coupled to the cleaning assembly for moving the cleaning assembly relative to the filtration member; and a bypass assembly coupled to the inner pipe, the bypass assembly configured to open when a pressure differential between an exterior of the inner pipe and an interior of the inner pipe hits a predetermined value.

21. A downhole debris removal apparatus, comprising:

an inner pipe positioned within a tubular;

a filtration member substantially encircling the inner pipe;

a base plate located at a downhole end of the tubular, the base plate and tubular forming a debris collection chamber at the downhole end of the tubular a cleaning assembly positioned radially about at least a portion of the filtration member, the cleaning assembly configured to move relative to the filtration member to dislodge particulate matter from the filtration member; and a bypass assembly coupled to the inner pipe, the bypass assembly configured to open when a pressure differential between an exterior of the inner pipe and an interior of the inner pipe hits a predetermined value.

* * * * *